US010463174B2

(12) United States Patent
Hesselmann et al.

(10) Patent No.: US 10,463,174 B2
(45) Date of Patent: Nov. 5, 2019

(54) PORTABLE SERVICE BAR

(71) Applicant: Smartbar AS, Oslo (NO)

(72) Inventors: Boerge Mathias Hesselmann, Oslo (NO); John Henrik With, Oslo (NO)

(73) Assignee: Smartbar AS, Oslo (NO)

( * ) Notice: Subject to any disclaimer, the term of this patent is extended or adjusted under 35 U.S.C. 154(b) by 0 days.

(21) Appl. No.: 15/842,960

(22) Filed: Dec. 15, 2017

(65) Prior Publication Data

US 2018/0103780 A1 Apr. 19, 2018

Related U.S. Application Data

(63) Continuation of application No. 13/822,639, filed as application No. PCT/NO2011/000256 on Sep. 16, 2011, now abandoned.

(30) Foreign Application Priority Data

Sep. 17, 2010 (NO) ..... 20101298

(51) Int. Cl.
*A47F 5/10* (2006.01)
*A47F 9/00* (2006.01)

(52) U.S. Cl.
CPC . *A47F 5/10* (2013.01); *A47F 9/00* (2013.01)

(58) Field of Classification Search
CPC ... A47F 9/00; A47F 5/10; A47F 5/116; A47B 43/00
USPC ..... 108/179, 171, 173–175, 162, 166, 167, 108/115, 59, 60, 83; 16/362; 312/258–262, 140.1–140.4, 322, 323
See application file for complete search history.

(56) References Cited

U.S. PATENT DOCUMENTS 25,089 A * 8/1859 Browne
1,913,387 A * 6/1933 Hayward ..... A47B 69/00 312/140.2
1,948,703 A * 2/1934 Fanarjian ..... A47B 17/036 312/196
1,949,118 A * 2/1934 Earley ..... A47B 21/03 312/29
2,185,513 A * 1/1940 Middleton ..... A47B 43/02 312/281
2,260,586 A * 10/1941 Sheldon ..... A47B 69/00 144/285
2,351,610 A * 6/1944 Hamberg ..... A47B 17/033 312/194
2,525,975 A * 10/1950 Thomas ..... A47B 17/036 16/362
D171,856 S * 3/1954 Mont ..... 312/140.2
(Continued)

FOREIGN PATENT DOCUMENTS

DE 102006057394 * 6/2008
GB 405167 * 2/1934
(Continued)

*Primary Examiner* — Janet M Wilkens
(74) *Attorney, Agent, or Firm* — Christian D. Abel

(57) ABSTRACT

A portable service bar, useful, for instance, as a bar or a check-in counter. The portable service bar has at least one front wall where each front wall has a top front plate pivotally attached to its upper edge, at least two side walls, where each side wall has a side top plate pivotally attached to the upper edge of the side wall, each of the side walls further being pivotally connected to edges adjacent to the upper edge of the front wall.

11 Claims, 13 Drawing Sheets

(56) References Cited

U.S. PATENT DOCUMENTS 2,725,274 A * 11/1955 Stivale ..... A47B 69/00 312/140.2
2,764,462 A * 9/1956 McDonald ..... A47B 43/02 211/149
2,771,334 A * 11/1956 Wahlbom ..... A47B 69/00 108/166
3,097,028 A * 7/1963 Pieschel ..... A47B 69/00 108/129
3,140,133 A * 7/1964 Kraft ..... A47B 69/00 312/140.2
3,467,432 A * 9/1969 Sullivan ..... A47C 7/70 16/364
3,588,209 A * 6/1971 Nathan ..... A47B 43/00 312/140.2
3,841,728 A * 10/1974 Petersen ..... A47B 43/00 108/159
3,927,924 A * 12/1975 Kelley ..... A47B 87/002 312/263
4,099,809 A * 7/1978 Leotta ..... A47B 43/00 312/140.2
6,048,044 A * 4/2000 Biggel ..... A47B 21/00 312/223.3
6,663,202 B2 * 12/2003 Spann ..... A61G 12/001 312/241
6,854,400 B2 * 2/2005 Sullivan ..... B60P 1/00 105/372
7,240,975 B2 * 7/2007 DeMars ..... A47B 77/10 108/50.12
8,267,490 B2 * 9/2012 DeMars ..... A47F 9/00 108/115
2006/0191446 A1 * 8/2006 Discacciati ..... A47B 3/12 108/59
2008/0302279 A1 * 12/2008 Clifton ..... A47B 47/042 108/60
2010/0314979 A1 * 12/2010 Ceballos-Godefroy ..... A47F 5/10 312/244
2012/0181905 A1 * 7/2012 Ceballos-Godefroy ..... A47F 3/004 312/140.3
2015/0223603 A1 * 8/2015 Dart ..... A47B 45/00 108/65

FOREIGN PATENT DOCUMENTS

GB 1015966 * 5/1964
GB 2267025 * 11/1993

* cited by examiner

PORTABLE SERVICE BAR

CROSS REFERENCE TO REPLATED APPLICATIONS

The present application is a Continuation under 35 U.S.C. § 120 of U.S. application Ser. No. 13/822,639 filed 13 Mar. 2013, which is a National Stage application of PCT/NO2011/000256 filed 16 Sep. 2011.

FIELD OF THE INVENTION

The present invention relates to a portable service point, for instance a bar from which beverages and/or food are to be served, and more particularly to a portable service point with collapsible components and framework, which can be assembled for use and disassembled for transport and storage.

BACKGROUND OF THE INVENTION

It is common when organizing a social event, or similar activity, to require the temporary use of a vending counter or a bar for known purposes, in a location not provided with such facilities. Use of ordinary tables or similar articles may not be adequate for a number of reasons, including the facility they fail to provide. Transportation of purpose-built bar facilities may be inconvenient du to their size and/or shape.

Examples of various types of portable bar structures of a cabinet type, or similar cabinet structures, are shown by these US patents: U.S. Pat. Nos. 2,351,610, 2,725,274, 2,764,462 and 3,097,028.

From GB 2.267.025 is known a folding work-surface and shelving apparatus or kit, suitable for use as a portable drinks bar or vending counter, where the apparatus or kit comprises a front panel, two side panels, a work-surface, an open back, a partition panel and at least one shelf. The apparatus or kit is designed to allow compact folding and stowage into a conveniently transported and easily stored unit. The side panel and front panel can be folded in such a way that the work-surface may be stowed between the panels when folded, and likewise the side panel, front panel and partition panel will form a stowage space for shelves when folded.

It is among the objectives of the present invention to obviate or mitigate one or more of the disadvantages known from prior art.

BRIEF SUMMARY OF THE INVENTION

Accordingly, one object of the present invention is therefore to provide easily transportable apparatus suitable for use as a bar or the like.

Another object of the present invention is to provide a portable service point, where the portable service point in addition is foldable.

It is a further object of the present invention to provide as an integral part of said apparatus, convenient facilities beneath and behind said apparatus for the storage of items, such as bottles and beer barrels or the like.

It is further an object of the present invention to provide a portable service point which is inexpensive and simple to manufacture.

These objectives are achieved with a portable service point according to the invention as defined in the enclosed independent claims, where embodiments of the invention are given in independent claims.

The present invention relates to the provision of a foldable service point, for instance a bar, which when folded will be a compact and manageable size. When in use, the portable service point is opened up to create a (bar) structure having a relatively large amount of counter space, and at least adequate storage space and room for the alcoholic beverages, the mixers, ice etc., which the bartender needs to perform his function. However, it should be understood that the portable service point according to the present invention could also be manufactured as a check-in counter, switchboard counter, presentation stand etc.

In its basic form, the foldable service point of the present invention comprises one or more front walls, two or more sidewalls, a working plate and top front and top side plates, which together define a service point having an innerspace.

According to a preferred embodiment of the present invention, a portable and collapsible service point is provided, where the portable and collapsible service point comprises at least one front wall being pivotally connected to at least two side walls, the front wall and side walls being connected through their side edges. A top front plate and top side plate are furthermore pivotally attached to upper edges of the front and side walls respectively. The front wall, side walls and the top front and top side plates can be assembled in order to create a service point for use or disassembled in order to create a service point for transport and/or storage.

The pivot connection between the different walls and top plates of the portable and foldable service point may, for instance, be constituted of a hinge joint, piano hinge, a hinge-pin or the like.

When the portable service point is to be disassembled, the front wall and the side walls are pivoted to a folded position where the front wall and side walls are arranged essentially parallel with each other.

In an operable position ready to use, the side walls and front wall are arranged to be placed in an open position wherein each side wall is arranged essentially perpendicular to the front wall of the portable service point.

Furthermore, in order to lock the portable service point in the operable position ready to use, the top front plate and top side plate are lifted up to a horizontal position, whereafter the top side plates are push into abutment with the top front plate, such that an abutting portion of each of the top side plates engages with an abutting portion of the top front plate.

The abutting portion of the top side plate and the abutting portion of the top front plate are shaped in such a way that one of the abutting portions accommodates the other. Preferably the abutting portion of the top front plate is shaped as a rail and the other abutting portion, i.e. the abutting portion of the side top plate is shaped as a recess. When the portable service point is ready to use, the recess of the side top plate will accommodate the rail of the top front plate. However, it should be understood that the top front plate can be shaped with a recess, while the top side plate then can be shaped with a rail. Other arrangements can also be used.

In a preferred embodiment of the present invention, the top side plates are slideably connected to the upper edges of the side walls, where the abutting portions are used as sliding means in order to bring the abutting portion into the engaged position with one another.

The portable service point may also comprise at least one working plate, where the working plate is pivotally connected to an inner side surface of each of the front walls. The working plate may include a major opening or hole for receiving a removable ice tub. The ice tub includes a laterally outwardly projecting peripheral flange. The working plate may therefore include a recess bordering the ice tub opening, sized to receive the tub flange, for mounting the top of the tub substantially flush with the top of the working plate The working plate may also include a plurality of minor openings offset from the tub opening on at least one side of the tub. The minor openings are adapted for receiving removable holders for the alcoholic beverage bottles and the condiments.

Furthermore, the working plates may also include a pair of legs, where the legs support the working plate when the portable service point is in use. The legs are pivotally connected to an underside of the working plates, and can be rearranged from a retracted and locked position to a folded out position, in order to support the working plates.

The portable service point may further include handle means and wheels, in order to ease the assembling and disassembling of the portable service point. The wheels may further be lockable, such that the portable service point can be "locked" in a desired position. The portable service point may also include locking means, so that the side walls can be locked to each other and/or to the front wall(s), in order to prevent the portable service point being unfolded unintentionally.

When the portable service point according to the present invention is to be assembled for use, the side walls are unlocked and dragged into a position where the side walls are positioned essentially perpendicular to the front wall. In order to ease the assembling and disassembling of the portable service point, the side walls and/or front walls can be equipped with handles, bars etc.

Thereafter the top front plates are swung into their horizontal position and are locked to each other by a locking rail. The locking rail is pushed in between the edges of the top front plates which are abutting each other, whereby flanges of the locking rail will cover a part of each top front plate edge and thus lock the top front plates together. The locking rail may for instance have an H-profile. After the top front plates have been locked to each other, the top side plates, which are slideably and pivotally arranged to the side walls, are moved in their longitudinal direction, towards the top front plates. Edges of the top front plates and top side plates are provided with an abutting portion, such that one abutting portion will accommodate the other abutting portion, when the top side plates are moved to their foremost position. This will result in the top side plates becoming locked to the top front plates. The abutting portions of the top side plates and top front plates may for instance be constituted of a rail and a recess, where the recess will accommodate the rail when the correct positioning of the top side plates relative to the top front plates are achieved. When the top side plates and top front plates, by use of the abutting portions and locking rail, have been correctly locked to each other, the portable service point will be in a stable position. The working plate, which is pivotally connected to the inner side surface of each of the front walls, may then be swung up to its horizontal position. The working plate can be locked in this horizontal position by locking means provided on the inner side surface of either the side walls or the front walls. The working plate also comprises a pair of legs, where the legs, when folded out, will support the working plate. The portable service point is now in an operable position and ready to use. Additional equipment can now be attached, for instance, to the working plate, to the inner side surfaces of the side walls and/or front walls. This additional equipment may for instance be an ice tub, shelves for bottles, glasses etc.

The present invention has now been described according to one specific embodiment in the form of a portable and foldable bar. However, it should be understood that various changes and modifications to the presently preferred embodiment described herein will be apparent to those skilled in the art. For instance, the portable service point may also be manufactured as a check-in counter, switchboard counter, presentation stand etc., where the portable service point then is to be adapted for this specific use.

BRIEF DESCRIPTION OF THE DRAWINGS

The foregoing and other objects, features and advantages of the present invention will be apparent from the following more particular description of preferred nonlimiting embodiments of the invention, as illustrated in the accompanying drawings, where:

FIG. 1A shows the portable service point in an open position, FIG. 1B shows the portable service point in a partly folded position and FIG. 1C shows the portable service point in a completely folded position, ready for shipment and/or storage.

DETAILED DESCRIPTION OF THE INVENTION

Figure 1A:
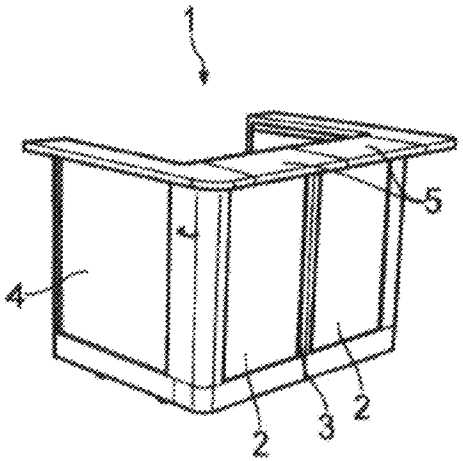
FIGS. 1A-C illustrates the folding of a portable service point, where

FIG. 1A shows a portable service point 1 in an open position, where the service point 1 comprises two front wall plates 2 that are pivotally connected along one of their sides (side edges). This pivot connection can for instance be made of a hinge joint (not shown) that extends over the entire length of the front wall plates 2 side edges. The hinge joint is arranged in such a way that the front sides of the front wall plates 2 will be situated towards each other when the service point 1 is in a completely folded position, as shown in FIG. 1C. On their opposite sides/edges of the pivot connection between the front wall plates 2, each of the two front wall plates 2 are pivotally connected to an edge of a side wall plate 4, where this pivot connection for instance can also be constituted of a hinge joint, piano hinge or a hinge-pin (not shown).

The portable service point 1 can be locked in its open position, where this locking is done by a plurality of top front plates 5 and top side plates 6. These plates 5, 6 will form the counter of the portable service point 1. Each of the top front plates 5 is pivotally attached to an upper edge of the front wall plates 2, where the top front plates 5 in a folded position are arranged substantially parallel with the front wall plates 2. When the portable service point 1 is in its open position, as shown in FIG. 1A, the top front plates 5 are rotated approximately 90 degrees about their longitudinal axis (pivotal connection), whereby the top front plates 5 can be locked with the side top plates 6.

The top side plates 6 are, similarly to the top front plates 5, pivotally attached to the side wall plates 4 as illustrated in FIGS. 10-13. The top side plates 6 can therefore also be pivoted to a position substantially parallel to the side wall plates 4 (folded position in FIG. 1C), and rotated approximately 90 degrees to a locking position. In addition, the top side plates 6 are, through a hinge arrangement 30 illustrated in FIGS. 10-13, connected to the side wall plates 4 such that top side plates 6 can both pivot (rotate) and slide in the longitudinal direction with respect to the upper edge of side walls plates 4. The hinge arrangement 30 in one embodiment comprises a rail member 32 attached along an upper edge of side wall plates 4. Top side plates 6 have first hinge sections 35 attached along an edge as shown in FIGS. 10-13. First hinge section 35 comprises a cylindrical section that is slidably mounted on rail 32. This permits top side plate 6 to both rotate about, and slide along, rail 32.

The top side plates 6 will then be moved (horizontally) into abutment with the edges of the top front plates 5, whereby the top side plates 6 and the top front plates 5 can be fixed or locked to each other. This can be obtained, for instance, by the edges of the top front plates 5 are designed with an outwardly extending protrusion 20, where the edges of the top side plates 6 have a shape of a corresponding recess 21.

The edges of the top front plates 5 and top side plates 6 will then form adjacent parts/abutting portions 20, 21 between the top front plates 5 and top side plates 6.

The pivot connection between the different walls 2, 4 and top plates 5, 6 of the portable and foldable service point 1 may, for instance, be constituted of a hinge joint, piano hinge, a hinge-pin or the like. Preferably, the top side plate 6 is pivotally arranged to the side upper edge of side wall 4, and the top front plate 5 is arranged with top front plate edges and the top side plate 6 is arranged with adjacent top side plate edges 20, 21, where one of the top front plate edge 20, 21 is arranged to accommodate the adjacent top side plate edge 21, 20 and fastened by sliding means. Wherein the sliding means is being arranged on the top side plate edge 21, 20 and at least along the length of the said one top front plate edge. The top side plates 6 is further slideably connected to the side wall 4, the said plate being slideable on the side wall at least by the length of the said one top front plate edge.

According to the invention the top side plate 6 is both pivotally and slideably connected to the side wall 4 by a slideable hinge 30. The slideably hinge 30 is arranged such that is allows a pivotational and a relative movement between the top side plate 6 and the side wall 4.

As shown in FIGS. 10-13, according to an aspect of the invention, the slideably hinge 30 comprises at least one first hinge section 35 mounted to one of; the top side plate 6 or the side wall 4, and at least one second hinge section 36 connected to a rail 32 and arranged on the opposite part; top side plate 6 or the side wall 4.

The rail 32 is further connected to the at least one first hinge section 35 through a channel or eye arranged on the at least one first hinge section 35, the channel is arranged for holding the rail 32 in the channel but allows the rail 32 to slide through the channel.

According to the invention, the rail 32 is connected to the at least one second hinge section 36 and can be arranged on either one of the top side plate 6 or the side wall 4. The rail 32 is held in a position with a distance away and substantially in parallel to the top side plate 6 or the side wall 4. The rail 32 is fixed to the at least one second hinge section 36, but are moveable or slideable trough the at least one first hinge section 35.

In operation, the slideable hinge 30 allows the top side plate 6 to slide substantially parallel in relation to the side wall 4. Preferably, the at least one first hinge section 35 comprises two first hinge sections 35 arranged in a distance between each other, thus allowing the top side plate 6 to slide between said two hinge sections 35.

When the portable service point 1 is in a completely folded position, as shown in FIG. 1C, the pivot connections between the front wall plates 2 and the side wall plates 4 will allow the two front wall plates 2 to be arranged in a position inside and between the two side wall plates 4, whereby the portable service point 1 can be folded to a compact unit.

Figure 1B:
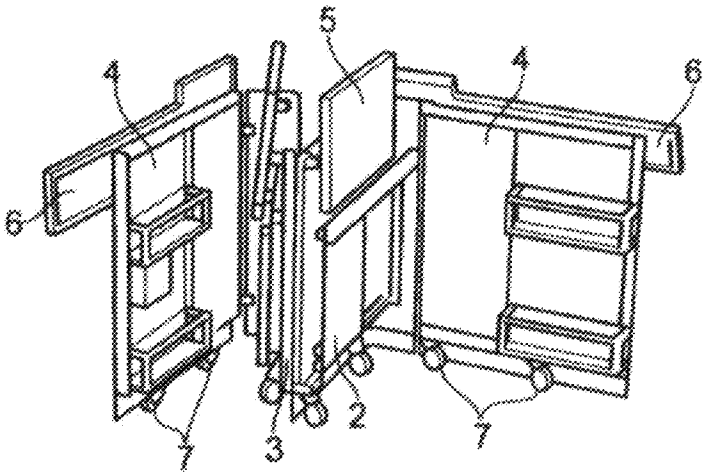
Figure 1C:
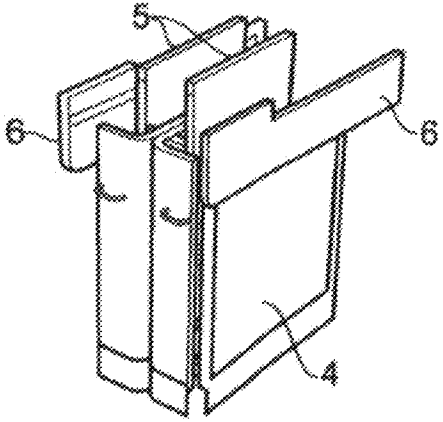

In FIG. 1B the portable service point 1 is shown in a partly folded position, as the top side plates 6 are released from the locking connection with the top front plates 5. The top side plates 6 are pulled out to their posterior position and rotated against their respective side wall plates 4. Similarly, the top front plates 5 are rotated to a folded position, where the top front plate 5 lies parallel with the respective front wall plate 2. Furthermore, the two front wall plates 2 are rotated about pivotal axis and retracted in between the side wall plates 4.

FIG. 1B shows how the inner sides of the front wall and side wall plates 2, 4 comprise shelves, brackets, holding devices etc., where these are to adapted to fit each and one of the specific applications of the portable service point 1.

In order to ease the handling of the portable service point 1, a plurality of lockable wheels 7 are arranged on the lower edges of each of the front wall and side wall plates 2, 4. Furthermore, the side walls 4 and/or front walls 2 are equipped with handles, bars etc. (not shown).

Reference is now made to a preferred application of the portable service point 1, where the portable service point 1 constitutes a bar. This is shown in FIGS. 2 to 9.

Figure 2:
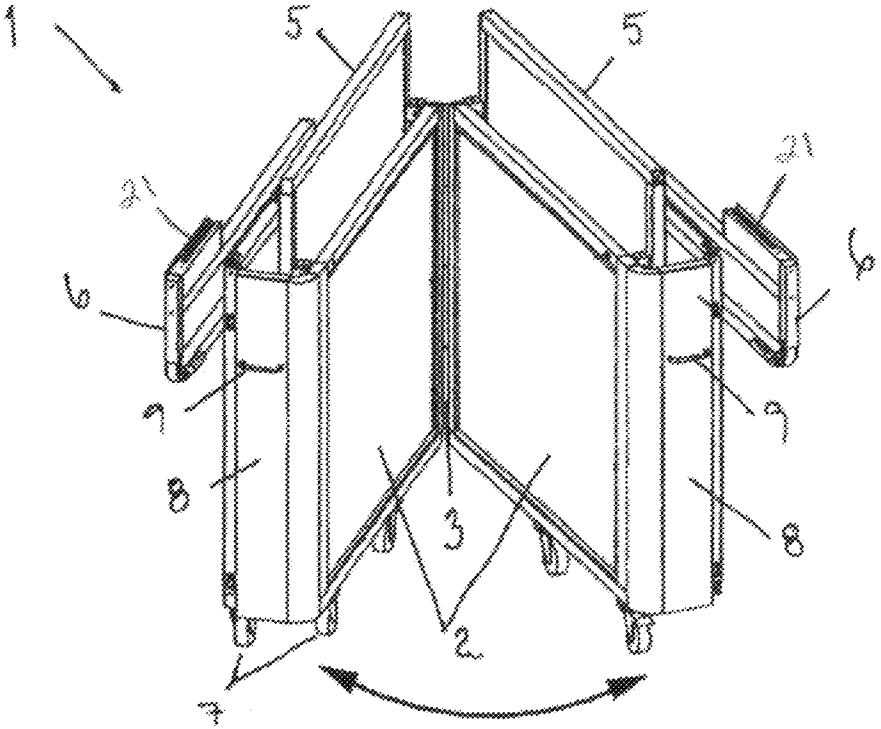
FIGS. 2-13 illustrate the assembling of the portable service point, where the service point in this preferred embodiment is shown as a bar.

In FIG. 2 the portable service point 1 (in the form of a bar) is to be assembled for use. Two additional wall plates 8 are on each of their sides pivotally connected to the front wall and side wall plates 2, 4 respectively. Each of the additional wall plates 8 is equipped with a holding and/or handling device 9, for instance in the form of a handle, where this will ease the assembling and disassembling of the portable service point 1. The handles 9 are used to "open" the folded front wall plates 2, where this will result in that the two front wall plates 2 are rotated about their pivotal connection 3. The lockable wheels 7, which are in an unlocked state, will ease the assembling of the portable service point 1.

Figure 3:
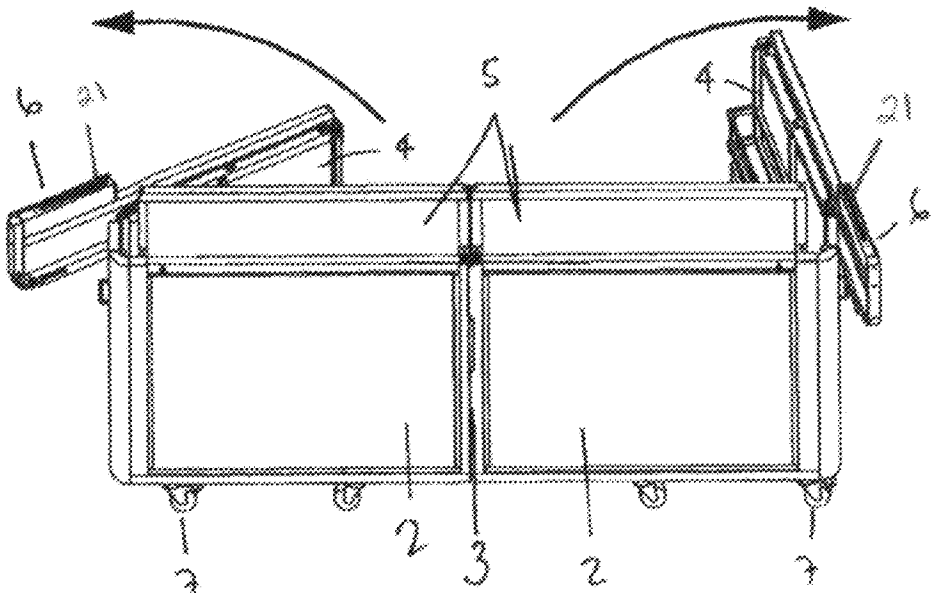

When the two front wall plates 2 are aligned with each other in order to form a "straight" front wall of the bar 1, as shown in FIG. 3, then the side wall plates 4 can be drawn out to a position substantially perpendicular to the front wall plates 2. When both the front wall plates 2 and the side wall plates 4 are brought to their "outermost" positions, the front and side wall plates 2, 4 will make the form of the bar 1. The bar 1 will in this embodiment then have a U-shaped form.

Figure 4:
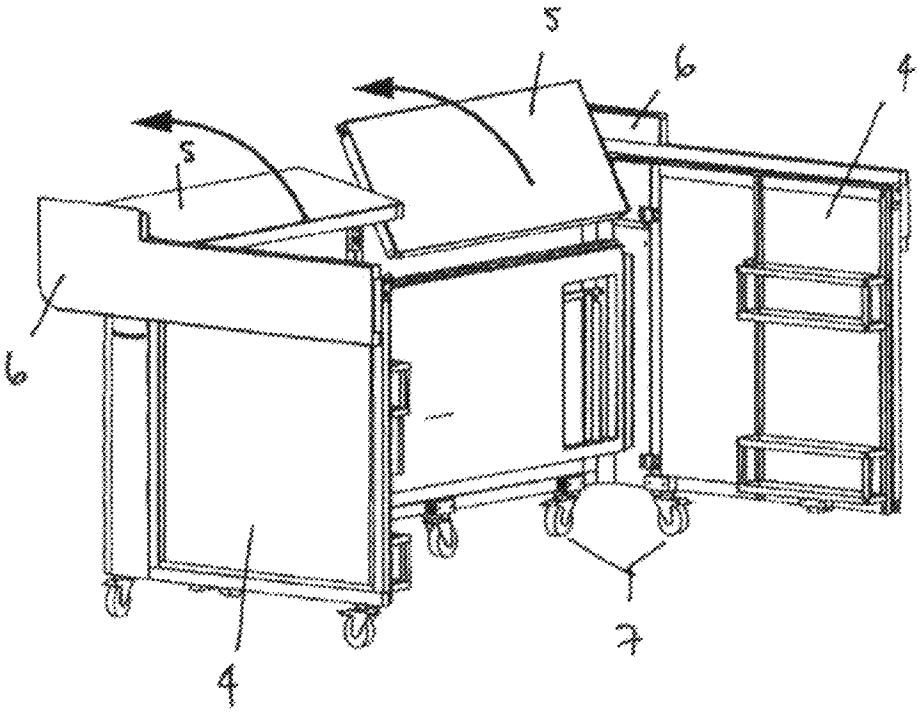

FIG. 4 shows how the two top front plates 5 are lifted up from their folded position, in order to form a part of the counter of the bar 1. The top front plates 5 are locked to each other by a locking rail 10 (see FIG. 5). The locking rail 10 may for instance have an H-shaped profile. In order to lock the two top front plates 5 relative to each other, the locking rail 10 is pushed in between the adjacent edges of the top front plates 5. Flanges of the H-profile will cover a part of the top front plates 5, and the top front plates 5 will be locked to each other.

Figure 5:
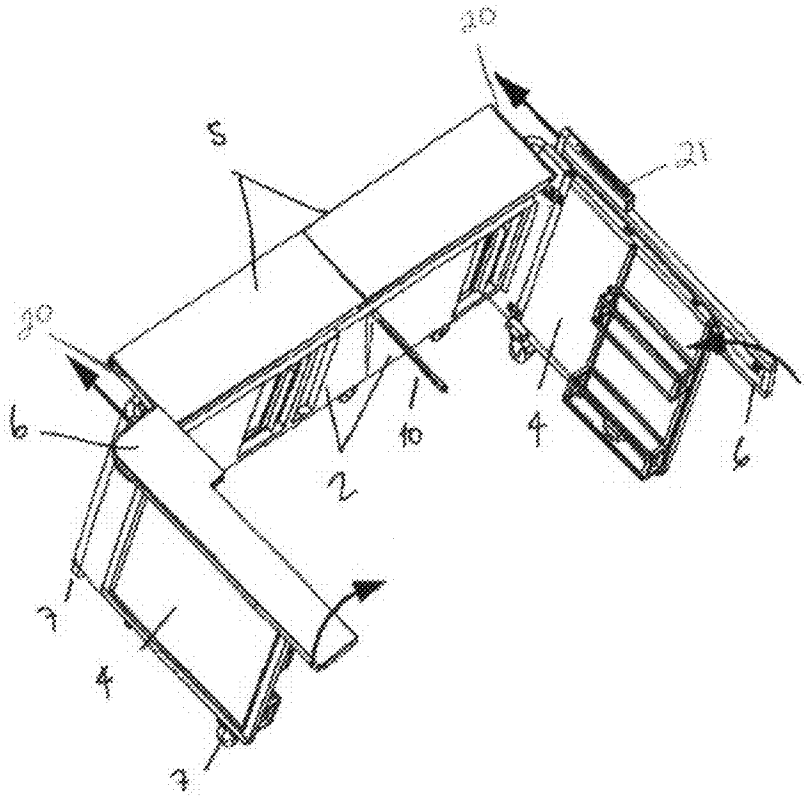
Figure 6:
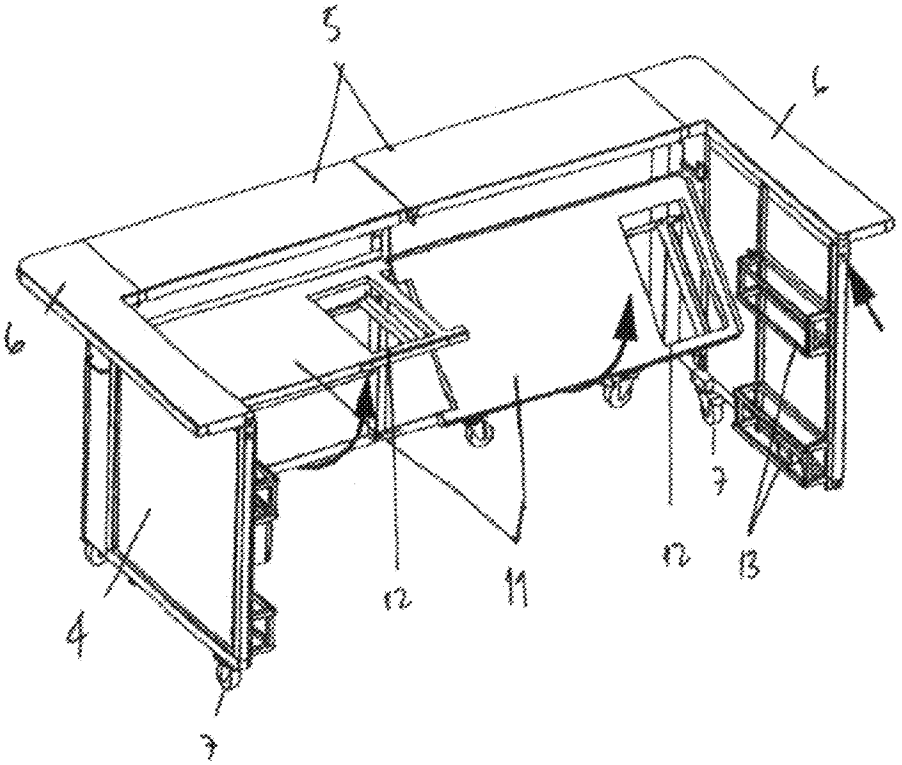
Figure 7:
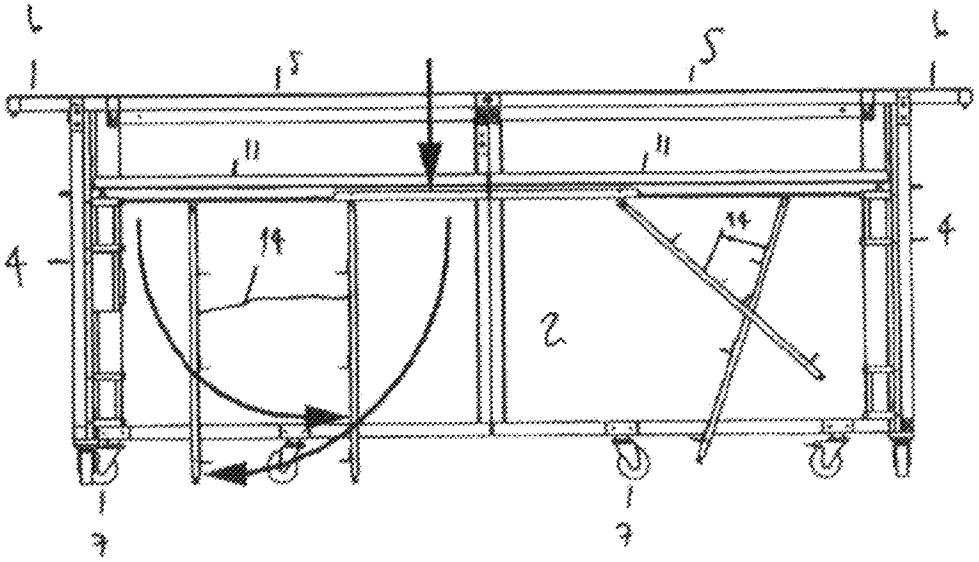

However, as the top front plates 5 are only locked with respect to each other, they must be prevented from rotating around their attachment point with the front wall plates 2. This is shown in FIG. 5, as the side front plates 6 are lifted to a position where the front side plates 6 are levelled or aligned with the top front plates 5, whereafter each of the front side plates 6 is pushed towards the edges of the top front plates 5. The edges of the front side plates 6 comprise a recess 21, where this recess 21 will cooperate with a corresponding outwardly extending protrusion 20 on the edges of the top front plates 5.

The front wall plates 2, side wall plates 4, top front plates 5 and top side plates 6 are now locked in relation to each other, whereby the bar 1 is fixed in this open position.

On the inside of each of the front wall plates 2, table plates 11 are pivotally attached, where the working plates 11, when erected, will form the "working bench" of the bar. The working plates 11 can for instance comprise one or more through apertures 12, into which through apertures 12 for instance an ice bucket (not shown) or similar equipment can be arranged. The working plates 11 also comprise locking means, such that they can be locked to the side wall plates 4. Each working plate 11 also comprises a pair of legs 14 (see FIG. 7), where the legs 14 can be locked in a retracted position underneath the working plates 11 when not in use. When the bar 1 is in use, see FIG. 7, the legs 14 are folded out in order to support the working plates 11.

The inside of the side wall plates 4 comprise different equipment, for instance shelves 13 for bottles etc.

Figure 8:
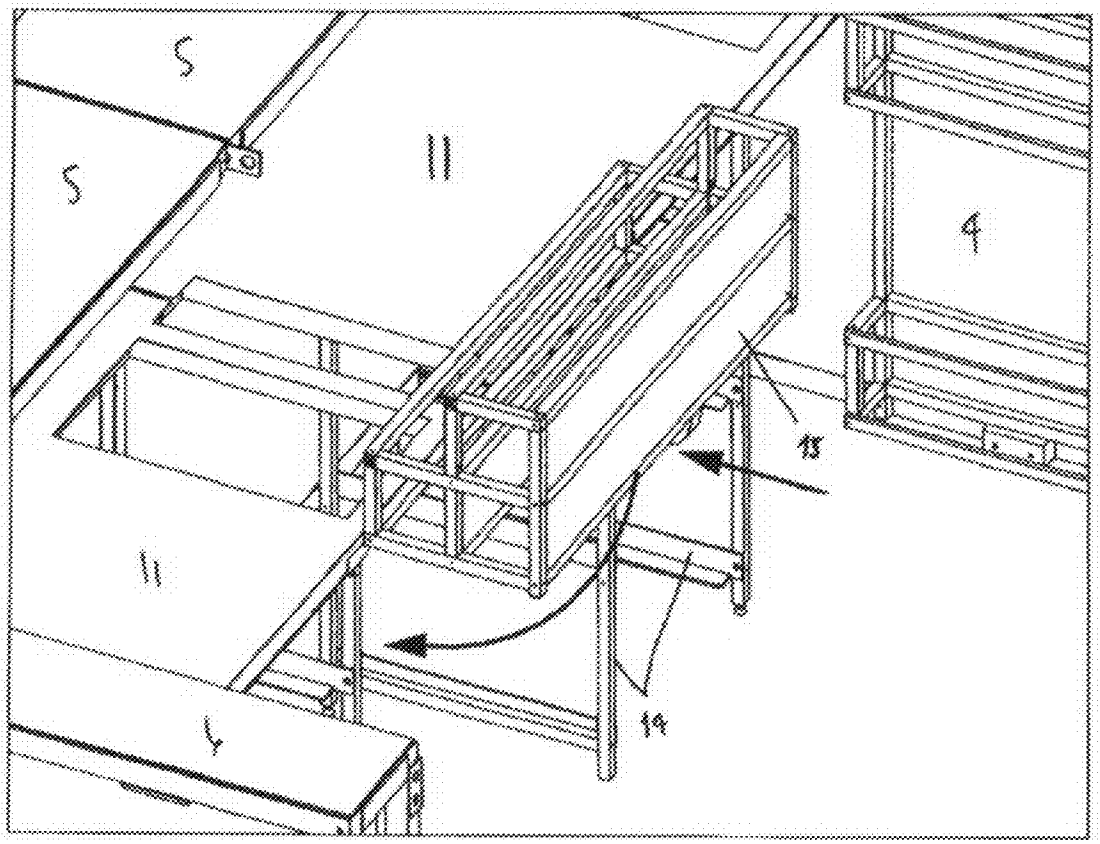

FIG. 8 shows how additional equipment can be attached to the table plates 11, as a "speed racket" 15 is connected to one or both of the table plates 11. In this case the working plate(s) 11 comprise(s) a profile slot or groove, where this profile slot or groove will cooperate with a corresponding slot or groove arranged on the "speed racket" 15. The slot or groove of the "speed racket" 15 is then placed in the corresponding slot or groove in the working plate 11, whereafter the "speed racket" 15 is turned 90 degrees in order to lock the "speed racket" to the working plate 11.

Figure 9:
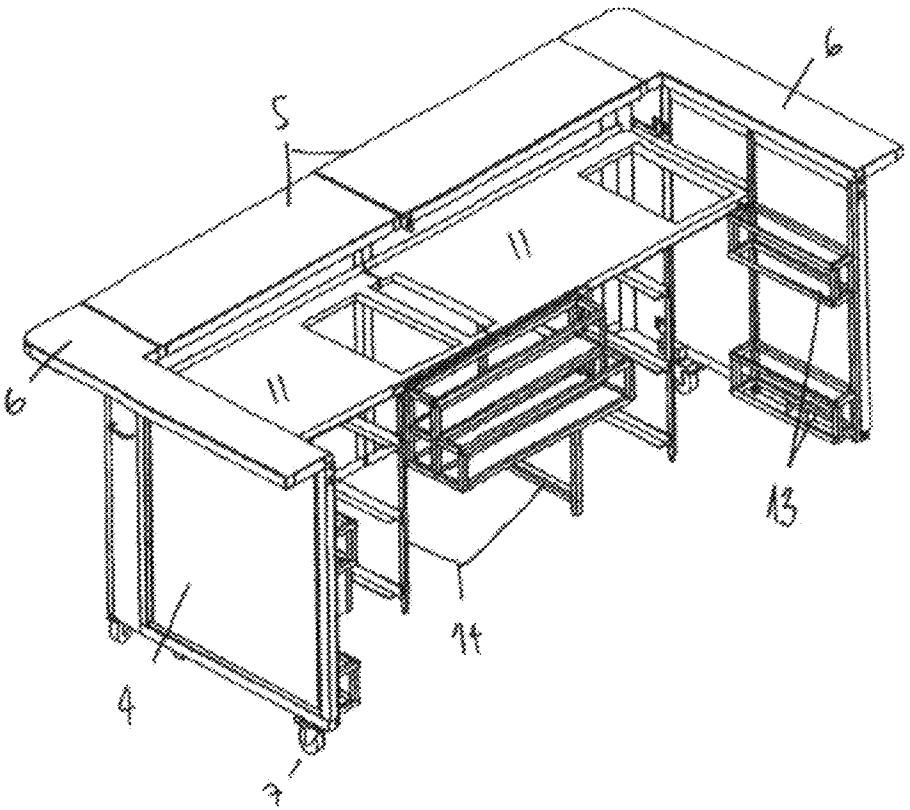
Figure 10:
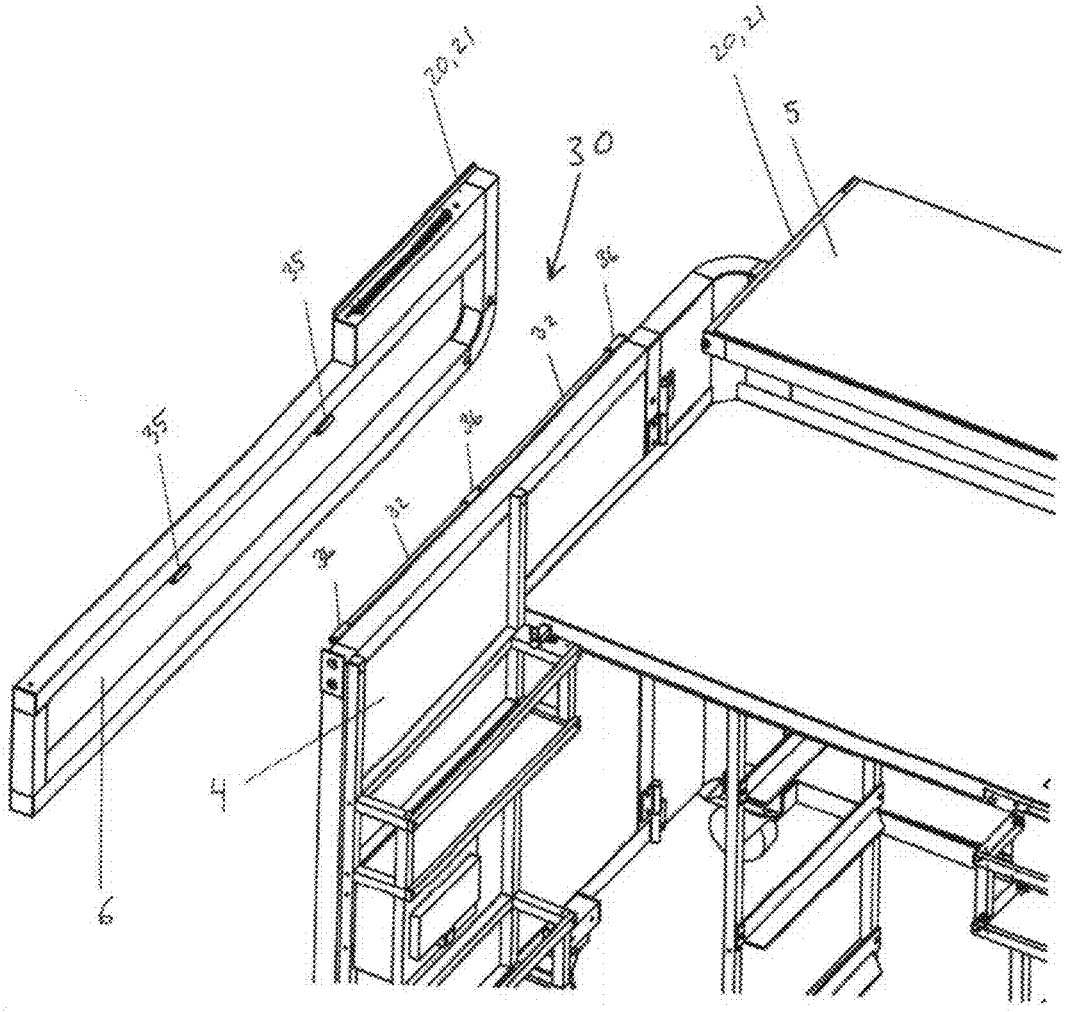
Figure 11:
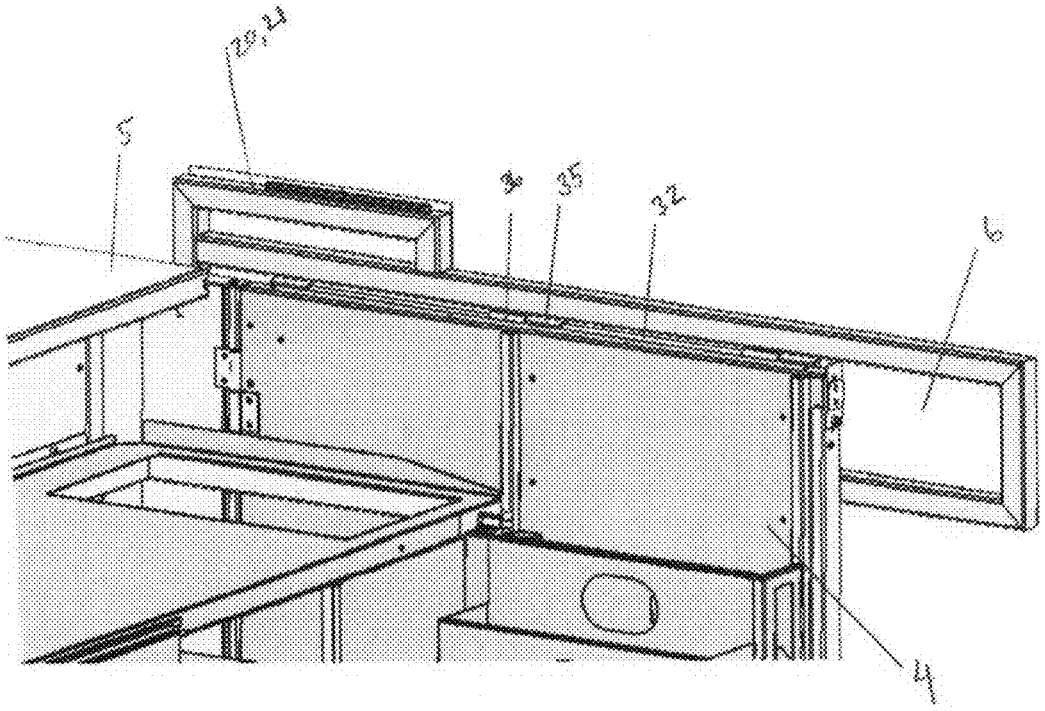
Figure 12:
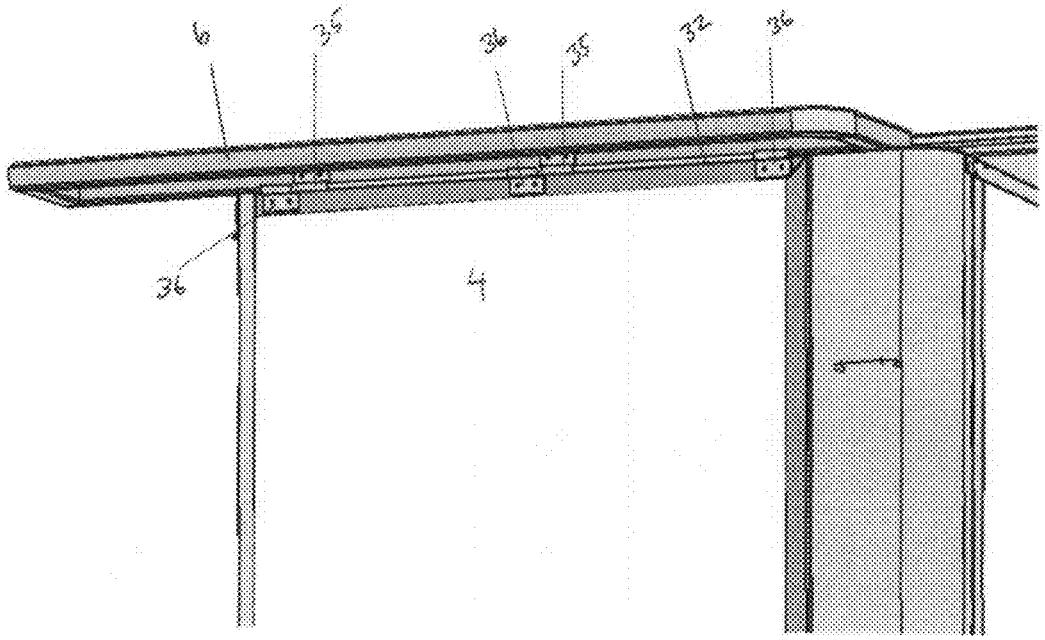
Figure 13:
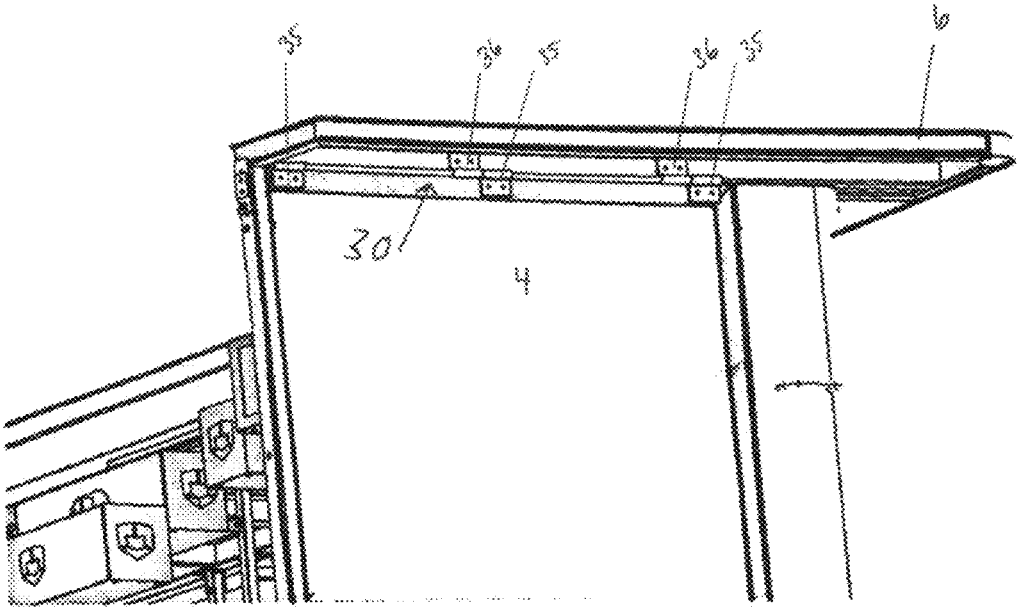

FIG. 9 shows the bar 1 in an open and fully assembled position.

The present invention has now been described according to one specific embodiment in the form of a portable and foldable bar. However, it should be understood that various changes and modifications to the presently preferred embodiments described herein will be apparent to those skilled in the art. For instance, the portable service point may also be manufactured as a check-in counter, switchboard counter, presentation stand etc., where the portable service point then is to be adapted for this specific use. Such changes and modifications may be made without departing from the spirit and scope of the present invention and without diminishing its attendant advantages. It is, therefore, intended that such changes and modifications be covered by the appended claims.

The invention claimed is:

1. A portable and foldable service bar comprising at least one front wall with a front upper edge and two front side edges, wherein each front wall has a top front plate pivotally connected to the front upper edge, at least two side walls, each pivotally connected to a corresponding front side edge, each of said side walls having a side upper edge, wherein each side wall has a top side plate pivotally and slidably attached to the side upper edge of the respective side wall by a pivotal and slidable hinge arrangement, wherein each top front plate is arranged with a top front plate edge and each top side plate is arranged with a corresponding top side plate edge, where each top front plate edge is arranged to accommodate an adjacent top side plate edge when the corresponding top side plate is slid in a forward direction and fastened thereto, wherein the top side plates are slideable along the respective side wall at least by the length of the adjacent said top front plate edge.

2. A portable service bar according to claim 1, characterized in that the pivotal and slidable hinge arrangement of each top side plate comprises a rod arranged along the side upper edge of the respective side wall and a first cylindrical hinge section connected to each of the top side plates, the first cylindrical section arranged about the respective rod such that the top side plates rotate in relation to, and slide along, the rod.

3. A portable service bar according to claim 1, characterized in that the side walls and the front wall are pivotally movable into a folded position wherein the side walls and the front wall are essentially parallel with each other.

4. A portable service bar according to claim 1 or 2, characterized in that the side walls and the front wall are arranged to be placed in an open position ready for use wherein each side wall is arranged essentially perpendicular to the front wall.

5. A portable service bar according to claim 1, characterized in that when the service bar is in an operable position ready to use, each top front plate and each of the top side plates are in horizontal positions and an adjacent part of each top side plate engages with an adjacent part of a corresponding top front plate.

6. A portable service bar according to claim 5, characterized in that of the adjacent part of each top side plate or the adjacent part of the corresponding front top plate; has the shape of a recess and the corresponding other adjacent part has the shape of a rail.

7. A portable service bar according to claim 1, characterized in that in an operable position ready to use, and wherein the at least one front wall comprises two front walls, the two front walls are included in the portable service bar and the two top front plates are arranged in a position wherein the edges of the two top front plates facing each other are abutting.

8. A portable service bar according to claim 1, characterized in that a working plate is pivotally connected to an inner side surface of each of the front walls and provided to be placed in a horizontal position and in an operable position ready for use of the portable service bar.

9. A portable service bar according to either of claim 1 or 8, characterized in that each top front plate, each top side plate and each working plate have folded positions wherein each top front plate, each top side plate and each working plate are placed in vertical positions essentially in parallel with each front wall and each side wall respectively.

10. A method for unfolding a portable service bar in accordance with claim 1, bringing the at least one front wall and the at least two side walls into a position wherein each side wall is arranged essentially perpendicular to each front wall, bringing each top front plate and each top side plate into a horizontal position, moving each top side plate along the upper edge of each side wall into a position wherein an adjacent part of the edge of each top side plate facing the top front plate engages with an adjacent part of the edge of the top front plate.

11. A method for unfolding a portable service bar, in accordance with claim 10, wherein bringing a working plate which is pivotally connected to an inner side surface of each of the front walls, into a horizontal position.

* * * * *